US008610634B2

(12) United States Patent
Aoki

(10) Patent No.: US 8,610,634 B2
(45) Date of Patent: Dec. 17, 2013

(54) ANTENNA

(71) Applicant: Casio Computer Co., Ltd., Tokyo (JP)

(72) Inventor: Yutaka Aoki, Ome (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 13/645,744

(22) Filed: Oct. 5, 2012

(65) Prior Publication Data

US 2013/0093639 A1 Apr. 18, 2013

(30) Foreign Application Priority Data

Oct. 12, 2011 (JP) ..... 2011-224789

(51) Int. Cl.
*H01Q 21/26* (2006.01)

(52) U.S. Cl.
USPC ..... 343/797; 343/795

(58) Field of Classification Search
USPC ..... 343/700 MS, 702, 797, 795, 820, 821
See application file for complete search history.

(56) References Cited

U.S. PATENT DOCUMENTS

| | | | | |
|---|---|---|---|---|
| 2008/0291106 | A1* | 11/2008 | Kai et al. | 343/797 |
| 2010/0265146 | A1* | 10/2010 | Montgomery et al. | 343/722 |
| 2011/0305174 | A1* | 12/2011 | Hensley et al. | 370/297 |
| 2012/0218162 | A1 | 8/2012 | Aoki et al. | |

FOREIGN PATENT DOCUMENTS

| | | | |
|---|---|---|---|
| JP | 58-182304 | A | 10/1983 |
| JP | 2009-044206 | A | 2/2009 |
| JP | 2009-044207 | A | 2/2009 |
| JP | 2011-035672 | A | 2/2011 |
| JP | 2011-176495 | A | 9/2011 |

OTHER PUBLICATIONS

Japanese Notice of Allowance dated Apr. 2, 2013 issued in counterpart Japanese Application No. 2011-224789.

* cited by examiner

*Primary Examiner* — Hoanganh Le
(74) *Attorney, Agent, or Firm* — Holtz, Holtz, Goodman & Chick, PC

(57) ABSTRACT

The present invention provides an antenna that enables circular polarization in a plurality of oscillation frequencies. A multi-frequency circular polarization antenna is formed with a substrate and multi-frequency antennas. The multi-frequency antennas are formed with antenna elements, shunt inductor conductors, series capacitor conductors, series inductor conductors, a center point, and input/output terminals. The multi-frequency antenna is arranged to cross the multi-frequency antenna at the center point to make an angle that is less than 90 degrees with respect to the multi-frequency antenna.

7 Claims, 13 Drawing Sheets

ANTENNA

CROSS-REFERENCE TO RELATED APPLICATION

This application claims the benefit of Japanese Patent Application No. 2011-224789, filed Oct. 12, 2011, the entire disclosure of which is incorporated by reference herein.

FIELD

This application relates generally to an antenna that enables circular polarization in a plurality of oscillation frequencies.

BACKGROUND

Various wireless communications systems mounting GPS (Global Positioning System), such as mobile terminals, car navigation, and the like, are in popular use. Given the popularity of ETC (Electronic Toll Collection System), for car navigation systems, there is a demand for development of antennas for vehicle-mounted use that support circular polarization in multiple frequencies of GPS and ETC. Furthermore, in addition to car navigation systems, there is also a demand for development of circular polarization antennas that can be built in the housing of small mobile terminals such as mobile telephones, digital cameras, PDAs, wrist watches, and the like.

SUMMARY

Then, an exemplary object of the present invention is to provide an antenna that enables circular polarization in a plurality of oscillation frequencies.

An antenna according to the present invention includes a first and second multi-frequency antennas, each including a configuration in which a first antenna and a second antenna are arranged in a substantially mirror-symmetrical manner, and, in this antenna:

the first antenna has a plurality of oscillation frequencies and includes a first input/output terminal, a first antenna conductor, a series circuit of a first inductor and a first capacitor, the series circuit connecting the first input/output terminal and the first antenna conductor, and a second inductor, one end of which is connected to the first antenna conductor;

the second antenna has a plurality of oscillation frequencies and includes a second input/output terminal, a second antenna conductor, a series circuit of a third inductor and a second capacitor, the series circuit connecting the second input/output terminal and the second antenna conductor, and a fourth inductor, one end of which is connected to the second antenna conductor and the other end of which is connected to the other end of the second inductor; and the first multi-frequency antenna and the second multi-frequency antenna are arranged to make a predetermined angle that is less than 90 degrees, such that a center point of the first multi-frequency antenna and a center point of the second multi-frequency antenna overlap, and the other end of the fourth inductor of the first multi-frequency antenna is connected to the other end of the fourth inductor of the second multi-frequency antenna.

BRIEF DESCRIPTION OF THE DRAWINGS

A more complete understanding of this application can be obtained when the following detailed description is considered in conjunction with the following drawings, in which.

DETAILED DESCRIPTION

First Embodiment

Figure 1:
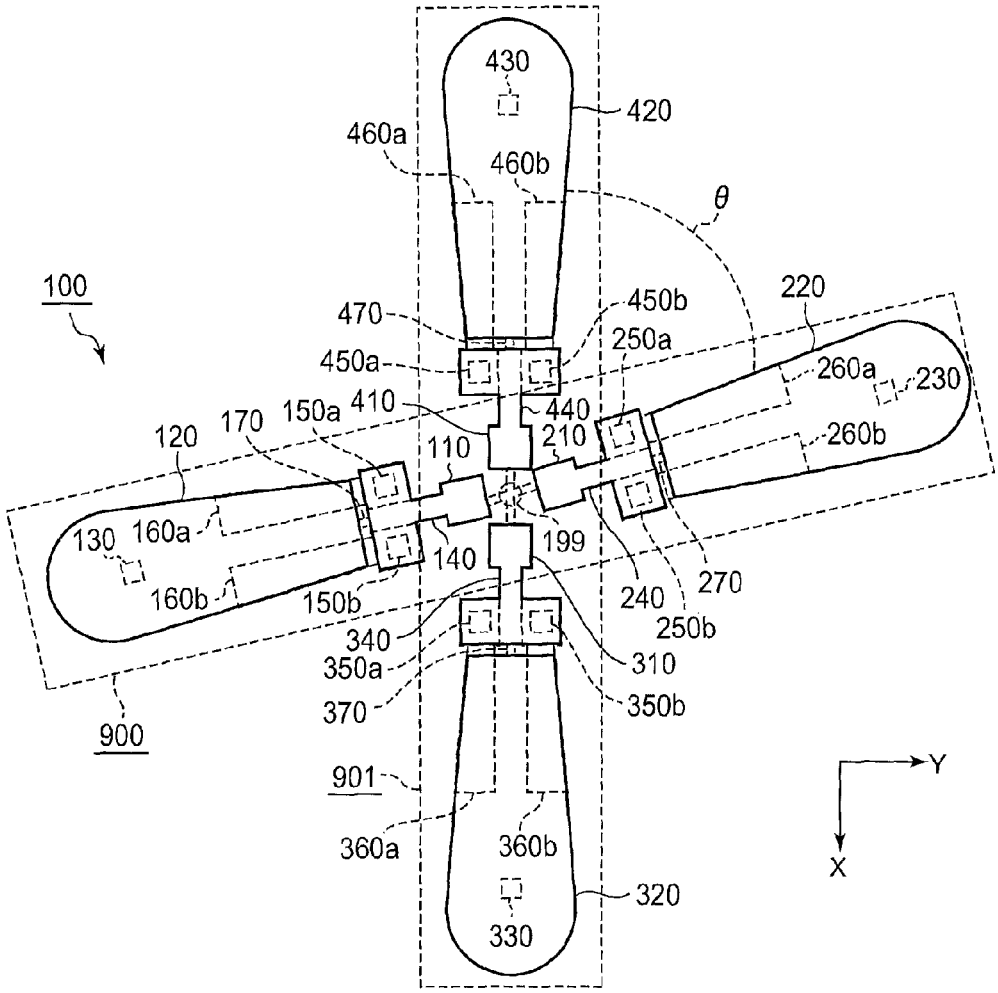
FIG. 1 is a plan view of a multi-frequency circular polarization antenna according to a first embodiment of the present invention.

Now, a multi-frequency circular polarization antenna 100 according to embodiment 1 of the present invention will be described.

The configuration of the multi-frequency circular polarization antenna 100 according to embodiment 1 will be described with reference to FIGS. 1 to 8. Note that the X, Y and Z axes in the drawings designate common directions throughout the drawings.

Figure 2:
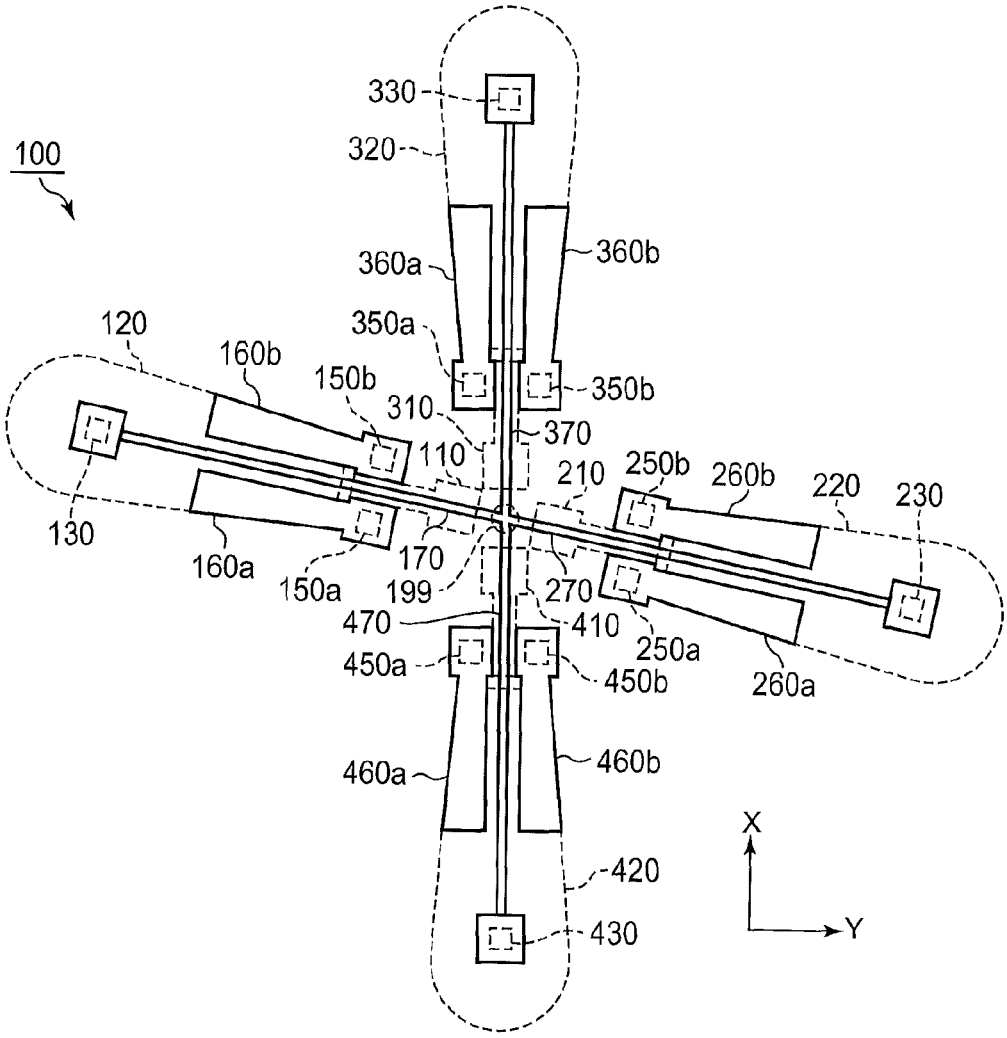
FIG. 2 is a bottom view of the multi-frequency circular polarization antenna illustrated in FIG. 1.

As illustrated in FIG. 1, the multi-frequency circular polarization antenna 100 is formed with a multi-frequency antenna 900 and a multi-frequency antenna 901. The multi-frequency antenna 900 and the multi-frequency antenna 901 have the same configuration, and the multi-frequency circular polarization antenna 100 is formed by connecting the multi-frequency antenna 900 and the multi-frequency antenna 901 at the center point 199 such that the angle formed between the multi-frequency antenna 900 and the multi-frequency antenna 901 is less than 90 degrees. To be more specific, as illustrated in FIG. 2, shunt inductor conductors 170 and 270 of the multi-frequency antenna 900 and shunt inductor conductors 370 and 470 of the multi-frequency antenna 901 are formed to be connected at the center point 199. The shunt inductor conductors 170, 270, 370 and 470 will be described later.

The configuration of the multi-frequency antenna 900 and multi-frequency antenna 901 forming the multi-frequency circular polarization antenna 100 will be described. Note that, as described above, the multi-frequency antenna 900 and the multi-frequency antenna 901 have the same configuration, and therefore each individual configuration of the multi-frequency antenna 901 will be shown in parentheses.

Figure 3:
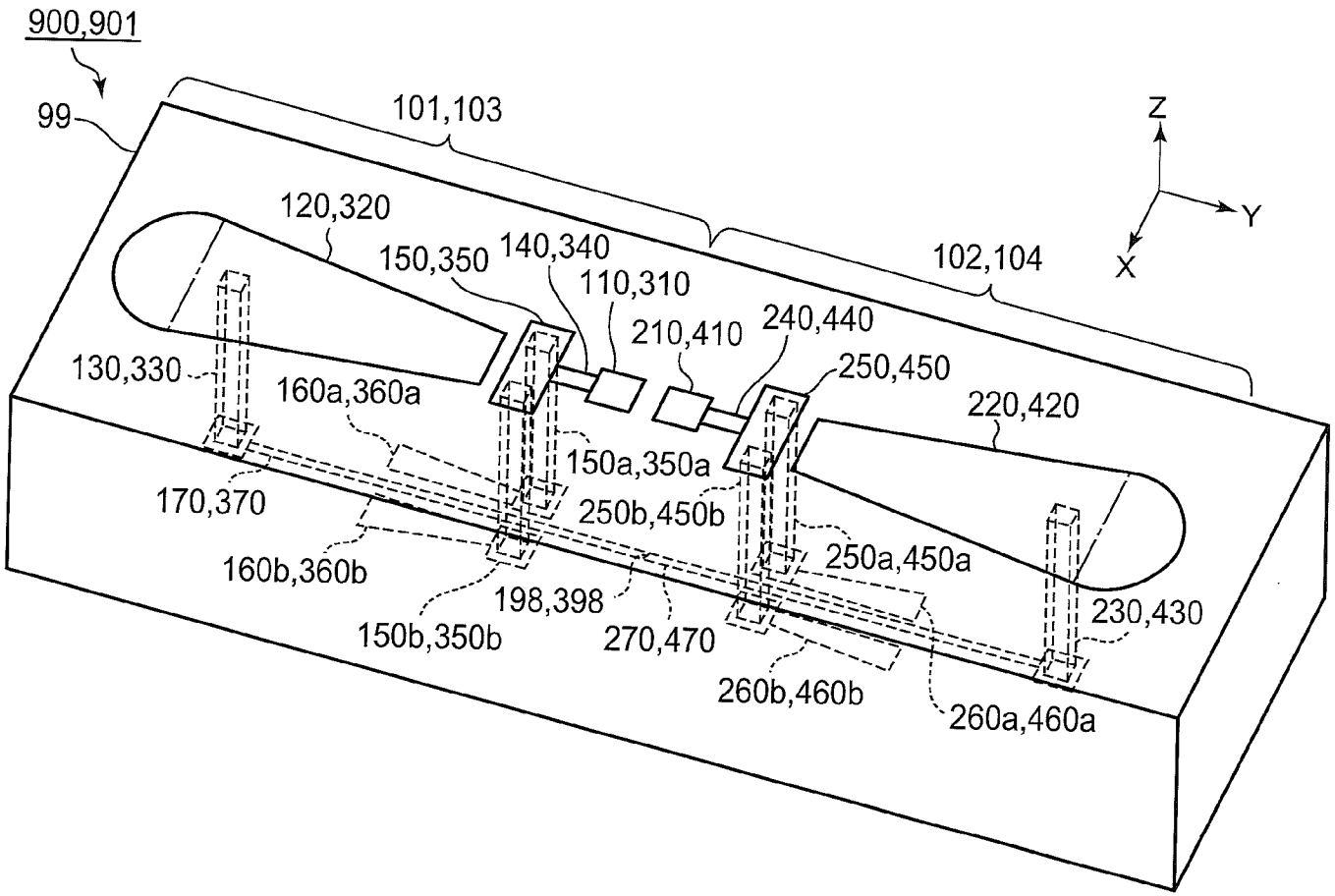
FIG. 3 is a perspective view of a multi-frequency antenna forming the multi-frequency circular polarization antenna illustrated in FIG. 1.
Figure 4:
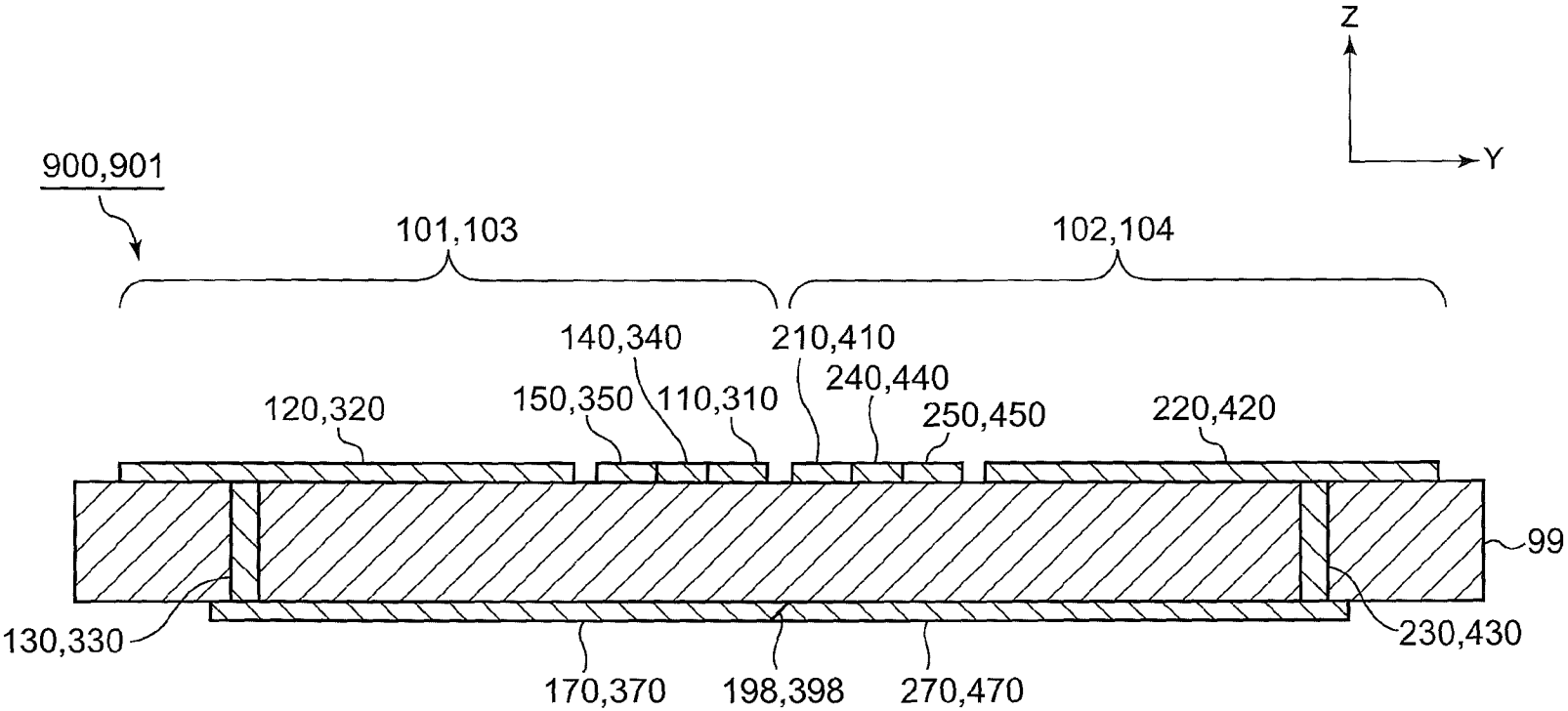
FIG. 4 is a cross-sectional view of the multi-frequency antenna forming the multi-frequency circular polarization antenna illustrated in FIG. 1.

As illustrated in FIG. 3 and FIG. 4, the multi-frequency antenna 900 (901) is formed with a substrate 99 and multi-frequency antennas 101 and 102 (103 and 104).

The substrate 99 is a plate-shaped dielectric, and is formed with, for example, a glass epoxy substrate (FR4).

The multi-frequency antenna 101 (103) and the multi-frequency antenna 102 (104) have the same configuration and are arranged on the substrate 99 in a substantially mirror-symmetrical manner such that the primary propagation direction of electromagnetic waves to be emitted is the same direction. The multi-frequency antennas 101 and 102 (103 and 104) are formed with input/output terminals 110 and 210 (310 and 410), antenna elements 120 and 220 (320 and 420), vias 130, 150*a*, 150*b*, 230, 250*a* and 250*b* (330, 350*a*, 350*b*, 430, 450*a* and 450*b*), via conductors 150 and 250 (350 and 450), series inductor conductors 140 and 240 (340 and 440), series capacitor conductors 160*a*, 160*b*, 260*a* and 260*b* (360*a*, 360*b*, 460*a* and 460*b*), and shunt inductor conductors 170 and 270 (370 and 470).

The input/output terminals 110 and 210 (310 and 410) are formed close to each other near the center of one main surface of the substrate 99, and each one-end part is connected to the other end of each of the series inductor conductors 140 and 240 (340 and 440). A pair of feeding wires, not illustrated, is connected to the input/output terminals 110 and 210 (310 and 410) and differential signals are supplied. The input/output terminals 110 and 210 (310 and 410) function as feeding points.

The antenna elements 120 and 220 (320 and 420) are each formed with a conductor plate of an isosceles trapezoid, in which the lower bottom is longer than the upper bottom, and a semi-circular conductor plate that is connected to the lower bottom of the isosceles trapezoid. The antenna element 120 (320) and the antenna element 220 (420) are arranged on one main surface of the substrate 99 such that the upper bottoms of the isosceles trapezoids face each other.

The vias 130 and 230 (330 and 430) are formed to penetrate substantially the intersection of the two diagonal lines of each isosceles trapezoid forming the antenna element 120 or 220 (320 or 420) from one main surface to the other main surface of the substrate 99. Conductors, one end of which is connected to the antenna elements 120 and 220 (320 and 420), are filled inside the vias 130 and 230 (330 and 430).

Via conductors 150 and 250 (350 and 450) are arranged on one main surface of the substrate 99. The via conductors 150 and 250 (350 and 450) are connected to series capacitor conductors 160*a* and 160*b*, and 260*a* and 260*b* (360*a* and 360*b*, and 460*a* and 460*b*), through two vias 150*a* and 150*b*, and 250*a* and 250*b* (350*a* and 350*b*, and 450*a* and 450*b*), which are formed to penetrate the substrate 99 from one main surface to the other main surface.

The series inductor conductors 140 and 240 (340 and 440) are formed with line conductors and formed on one main surface of the substrate 99, and their one ends are connected to the via conductors 150 and 250 (350 and 450).

The series capacitor conductor 160*a* (360*a*) and the series capacitor conductor 160*b* (360*b*) are arranged on the other main surface of the substrate 99, to sandwich the shunt inductor conductor 170 (370) in between, and to face part of the antenna element 120 (320). The parts of the series capacitor conductors 160*a* and 160*b* (360*a* and 360*b*) facing part of the antenna element 120 (320) and the part of the substrate 99 located between these, form a series capacitor that is connected in series to the antenna element 120 (320).

The series capacitor conductor 260*a* (460*a*) and the series capacitor conductor 260*b* (460*b*) are arranged on the other main surface of the substrate 99, to sandwich the shunt inductor conductor 270 (470) in between, and to face part of the antenna element 220 (420). The parts of the series capacitor conductors 260*a* and 260*b* (460*a* and 460*b*) facing part of the antenna element 220 (420) and the part of the substrate 99 located between these, form a series capacitor that is connected in series to the antenna element 220 (420).

The shunt inductor conductors 170 and 270 (370 and 470) are formed with line conductors and extend on the other main surface of the substrate 99, with their one ends being connected to the other end parts of the vias 130 and 230 (330 and 430). The other ends of the shunt inductor conductors 170 and 270 (370 and 470) are connected with each other at substantially the center point 199 of the other main surface of the substrate 99. That is to say, the multi-frequency antenna 101 (103) and the multi-frequency antenna 102 (104) are connected with each other in the center point 199.

The multi-frequency antenna 900 (901) emits a transmitting signal that is supplied between the input/output terminals 110 and 210 (310 and 410) into space as a radio wave, converts the received radio wave into an electrical signal, and transmits the electrical signal to the feeding wires from the input/output terminals 110 and 210 (310 and 410).

The multi-frequency antenna 900 (901) of the above configuration is made by, for example, opening vias 130, 150*a*, 150*b*, 230, 250*a* and 250*b* (330, 350*a*, 350*b*, 430, 450*a* and 450*b*) on the substrate 99, filling these openings by plating and/or the like, and, following this, pasting copper foils to both surfaces of the substrate 99 and patterning the copper foils through PEP (Photo Etching Process) and/or the like.

Figure 5:
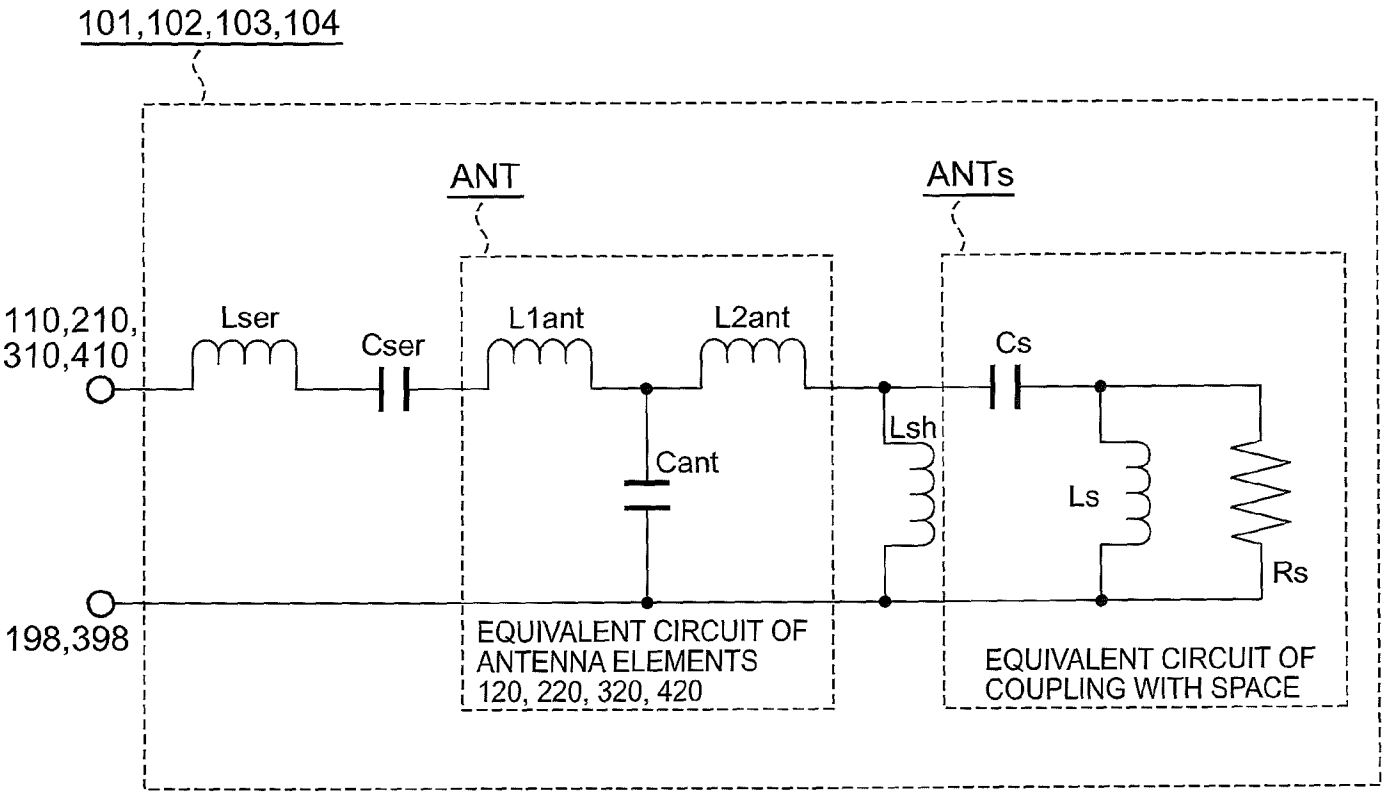
FIG. 5 is a diagram illustrating part of equivalent circuits of two multi-frequency antennas forming the multi-frequency antenna of the multi-frequency circular polarization antenna illustrated in FIG. 1.
Figure 6:
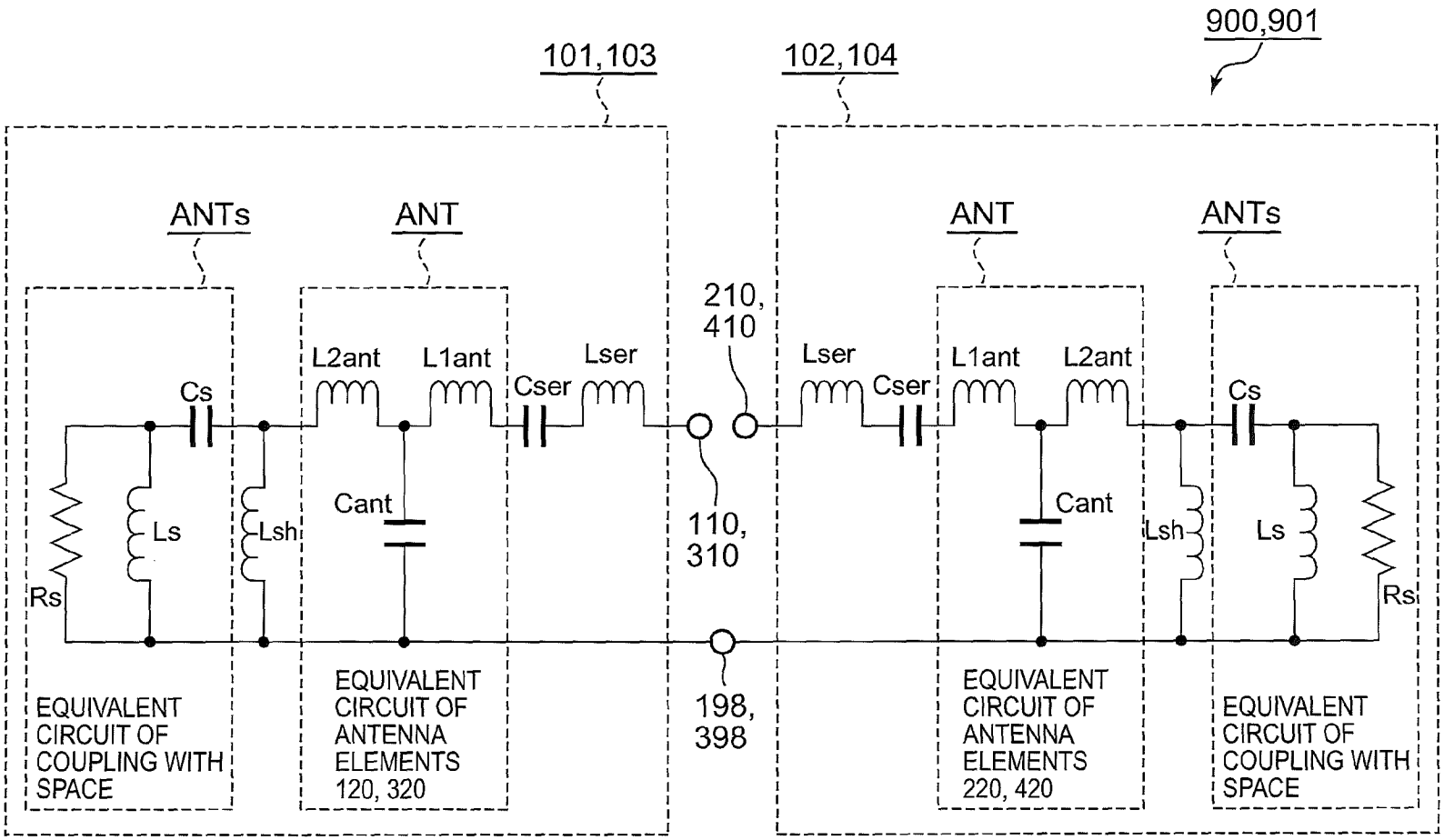
FIG. 6 is a diagram illustrating the equivalent circuits of the two multi-frequency antennas forming the multi-frequency antenna of the multi-frequency circular polarization antenna illustrated in FIG. 1.

The electrical configuration of the multi-frequency antennas 101 and 102 (103 and 104) forming the multi-frequency antenna 900 (901) having the above-described physical configuration is represented by the equivalent circuits illustrated in FIG. 5.

As illustrated in these drawings, electrically, the multi-frequency antennas 101 and 102 (103 and 104) are formed with a series inductor Lser, a series capacitor Cser, an equivalent circuit ANT of the antenna elements 120 and 220 (320 and 420), a shunt inductor Lsh, an equivalent circuit ANTs of coupling with space, the input/output terminals 110 and 210 (310 and 410), and a connection point 198 (398).

Note that the series inductor Lser corresponds to the inductance of the series inductor conductors 140 and 240 (340 and 440), and the shunt inductor Lsh corresponds to the inductance of the shunt inductor conductors 170 and 270 (370 and 470). Also, the series capacitor Cser corresponds to a series capacitor that is formed with the series capacitor conductors 160*a*, 160*b*, 260*a* and 260*b*, and/or the like (360*a*, 360*b*, 460*a* and 460*b*, and/or the like).

The equivalent circuit ANT of the antenna elements 120 and 220 (320 and 420) is a circuit that represents input impedance by a right-handed line, and is formed with an inductor L1*ant*, an inductor L2*ant*, and a capacitor Cant.

The inductance of the inductor L1*ant* in the equivalent circuit ANT of the antenna elements 120 and 220 (320 and 420), the inductance of the inductor L2*ant* and the capacitance of the capacitor Cant substantially depend on the size and shape of the antenna elements 120 and 220 (320 and 420) and are substantially fixed when the size and shape of the antenna elements 120 and 220 (320 and 420) are fixed.

The equivalent circuit ANTs of coupling with space depends on the size and shape of the antenna elements 120 and 220 (320 and 420), and is a circuit that represents impedance by the coupling of the antenna elements 120 and 220 (320 and 420) with space. The equivalent circuit ANTs of coupling with space is formed with a capacitor Cs, a reference impedance Rs and an inductor Ls.

One end of the series circuit of the series inductor Lser and the series capacitor Cser is connected to the input/output terminals 110 and 210 (310 and 410).

To the other end of the series circuit of the series inductor Lser and the series capacitor Cser, one end of the inductor L1*ant* forming the equivalent circuit ANT of the antenna elements 120 and 220 (320 and 420) is connected. One end of the capacitor Cant and one end of the inductor L2*ant* are connected to the other end of the inductor L1*ant*. The other end of the capacitor Cant is connected to the connection point 198 (398).

One end of the shunt inductor Lsh is connected to the other end of the inductor L2*ant*. The other end of the shunt inductor Lsh is connected to the connection point 198 (398).

One end of the capacitor Cs of the equivalent circuit ANTs of coupling with space is connected to the other end of the inductor L2*ant* and one end of the shunt inductor Lsh. To the other end of the capacitor Cs, one end of the inductor Ls and one end of the reference impedance Rs are connected. The other end of the inductor Ls and the other end of the reference impedance Rs are connected to the connection point 198 (398).

The value of the reference impedance Rs in the equivalent circuit ANTs of coupling with space depends on the size and shape of the antenna elements 120 and 220 (320 and 420). When a voltage of a target frequency is applied to the feeding point, the value of this reference impedance Rs is equivalent to the real component of the impedance representing the ratio of the applied voltage and the traveling current.

The capacitance of the capacitor Cs and the inductance of the inductor Ls in the equivalent circuit ANTs depend on the radius a of the sphere to incorporate the antenna elements 120 and 220 (320 and 420) and the reference impedance Rs, and is represented by following equations 1 and 2:

$$Cs=a/(c\times Rs) \quad (1)$$

$$Ls=(a\times Rs)/c \quad (2)$$

where Cs: the capacitance [F] of the capacitor Cs;

Ls: the inductance [H] of the inductor Ls;

Rs: the resistance value [Ω] of the reference impedance Rs;

a: the radius [m] of the sphere incorporating the antenna elements; and c: the light speed [m/s].

The multi-frequency antennas 101 and 102 (103 and 104) are connected with each other at the connection point 198 (398) and form the multi-frequency antenna 900 (901). The electrical configuration of the multi-frequency antenna 900 (901) is represented by the equivalent circuit illustrated in FIG. 6. A pair of feeding wires, not shown, is connected to the input/output terminals 110 and 210 (310 and 410).

The above is the configuration of the multi-frequency antennas 900 and 901 forming the multi-frequency circular polarization antenna 100.

As illustrated in FIG. 2, the multi-frequency circular polarization antenna 100 is formed by connecting the shunt inductor conductors 170 and 270 of the multi-frequency antenna 900 and the shunt inductor conductors 370 and 470 of the multi-frequency antenna 901, at the center point 199 of the antennas, such that the angle formed by these is less than 90 degrees.

Figure 7:
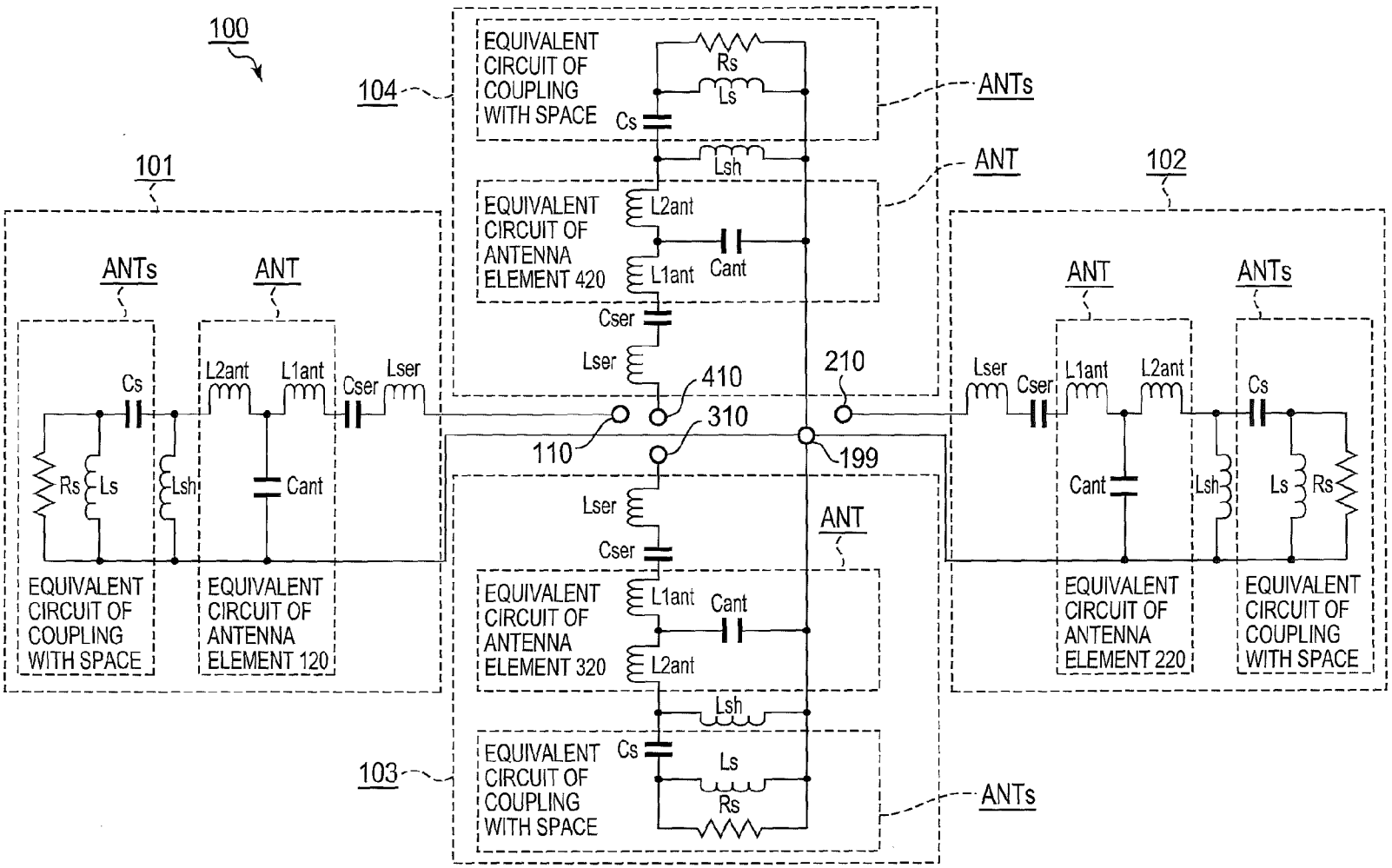
FIG. 7 is a diagram illustrating an overview of equivalent circuits of the multi-frequency circular polarization antenna illustrated in FIG. 1.

The electrical configuration of the multi-frequency circular polarization antenna 100 is represented by the equivalent circuit illustrated in FIG. 7. The patterns of the shunt inductor conductors 170, 270, 370 and 470, the series capacitor conductors 160*a* and 160*b*, 260*a*, 260*b*, 360*a*, 360*b*, 460*a* and 460*b*, and the series inductor conductors 140, 240, 340 and 440 are adjusted, such that, with respect to each frequency used in the multi-frequency circular polarization antenna 100, the imaginary number part of the input impedance becomes 0 and the real part becomes 50Ω.

Note that the inductance of each inductor and the capacitance of each capacitor in the equivalent circuit ANTs of the coupling of the antenna elements 120, 220, 320 and 420 with space are determined by above-described equations 1 and 2.

With the present embodiment, each pattern is adjusted such that the imaginary number part of the input impedance becomes 0 and the real part becomes 50Ω at two frequencies, 2.5 GHz and 5.2 GHz.

Figure 8A:
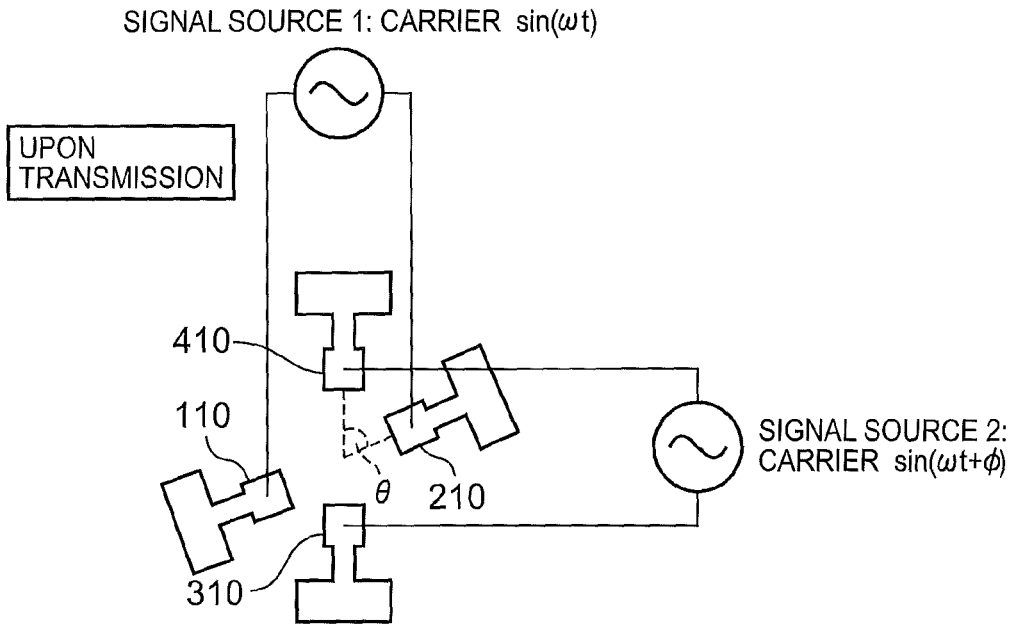
FIG. 8A is an enlarged view of input/output terminal parts, illustrating a configuration of the multi-frequency circular polarization antenna illustrated in FIG. 1 upon transmission.
Figure 8B:
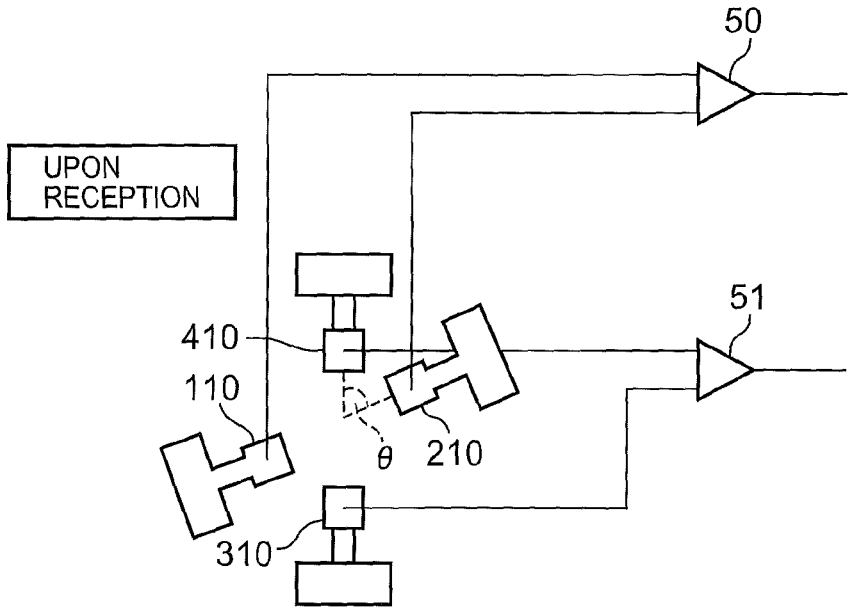
FIG. 8B is an enlarged view of input/output terminal parts, illustrating a configuration of the multi-frequency circular polarization antenna illustrated in FIG. 1 upon reception.

The input/output terminals 110, 210, 310 and 410 of the multi-frequency circular polarization antenna 100 are, as illustrated in FIG. 8A, connected with the signal source 1 or 2 through feeding wires. Also, as illustrated in FIG. 8B, the input/output terminals 110, 210, 310 and 410 are connected with an amplifier 50 or 51 through feeding wires. The amplifier 50 and 51 are each formed with, for example, a low noise amplifier and/or the like.

The multi-frequency circular polarization antenna 100 emits a transmitting signal that is supplied between the input/output terminals 110, 210, 310 and 410 into space as a radio wave, and, upon reception, converts the received radio wave into an electrical signal, and transmits the electrical signal to the feeding wires from the input/output terminals 110, 210, 310 and 410.

The operation of the multi-frequency circular polarization antenna 100 upon transmission will be described. As illustrated in FIG. 8A, the same signal is supplied to the input/output terminals 110 and 210, which form a pair. Similarly, the same signal is supplied to the input/output terminals 310 and 410, which form a pair.

Depending on the phase difference between the signal supplied to the input/output terminals 110 and 210 and the signal supplied to the input/output terminals 310 and 410, the multi-frequency circular polarization antenna 100 emits linear polarization or elliptical polarization in space.

To be more specific, when the signal supplied to the input/output terminals 110 and 210 and the signal supplied to the input/output terminals 310 and 410 are in-phase (when the phase ϕ of the carriers in FIG. 8A is 0), the linear polarizations to be emitted from the multi-frequency antennas 900 and 901 are also in-phase. The two linear polarizations are in-phase, so that their composite wave is also linearly polarized. Consequently, the multi-frequency circular polarization antenna 100 emits linear polarization.

By contrast with this, when there is a phase difference between the signal supplied to the input/output terminals 110 and 210 and the signal supplied to the input/output terminals 310 and 410 (when the phase ϕ of the carriers in FIG. 8A is not 0), a phase difference is also produced between the linear polarizations emitted from the multi-frequency antennas 900 and 901. Given that there is a phase difference between the two linear polarizations, their composite wave is elliptical polarization. Consequently, the multi-frequency circular polarization antenna 100 emits elliptical polarization.

In particular, when the angle formed between the multi-frequency antenna 900 and the multi-frequency antenna 901 is θ, the phase difference ϕ between the signal supplied to the input/output terminals 110 and 210 and the signal supplied to the input/output terminals 310 and 410 is π−θ, and these signals have an equal amplitude, the composite wave of the two linear polarizations to be emitted from the multi-frequency antennas 900 and 901 is circularly polarized, and the multi-frequency circular polarization antenna 100 therefore emits circular polarization.

Next, the operation of the multi-frequency circular polarization antenna 100 upon reception will be described. As illustrated in FIG. 8B, the multi-frequency circular polarization antenna 100 converts a received radio wave into an electrical signal and transmits the electrical signal from the input/output terminals 110 and 210, which form a pair, to the amplifier 50, through feeding wires. Similarly, also, from the input/output terminals 310 and 410, which form a pair, the electrical signal is transmitted to the amplifier 51 through feeding wires.

As described above, the multi-frequency circular polarization antenna 100 makes the imaginary number part of the input impedance 0 at 2.5 GHz and 5.2 GHz, oscillates at these frequencies and increases the gain. Consequently, the multi-frequency circular polarization antenna 100 functions as a multi-frequency circular polarization antenna that can achieve sufficient gain at two frequencies, 2.5 GHz and 5.2 GHz.

As described above, with the multi-frequency circular polarization antenna 100, by supplying signals having a phase difference that matches the angle θ formed between the multi-frequency antenna 900 and the multi-frequency antenna 901, it is possible to realize a compact circular polarization antenna of a light weight and a thin shape that operates at a plurality of oscillation frequencies.

Second Embodiment

The above multi-frequency circular polarization antenna 100 according to the first embodiment supplies signals having a phase difference that matches the angle θ formed between the multi-frequency antenna 900 and the multi-frequency antenna 901 to a pair of two input terminals, and by this means emits circular polarization to combine two linear polarizations emitted from the multi-frequency antennas 900 and 901. The multi-frequency circular polarization antenna 200 according to the present embodiment generates circular polarization which combines two linear polarizations, by adjusting the values of lumped constant components arranged in the antenna itself, without adding a new circuit for phase control by phase lines and/or the like, and emits circular polarization by one pair of input terminals.

The multi-frequency circular polarization antenna 200 according to the second embodiment will be described below.

Figure 9:
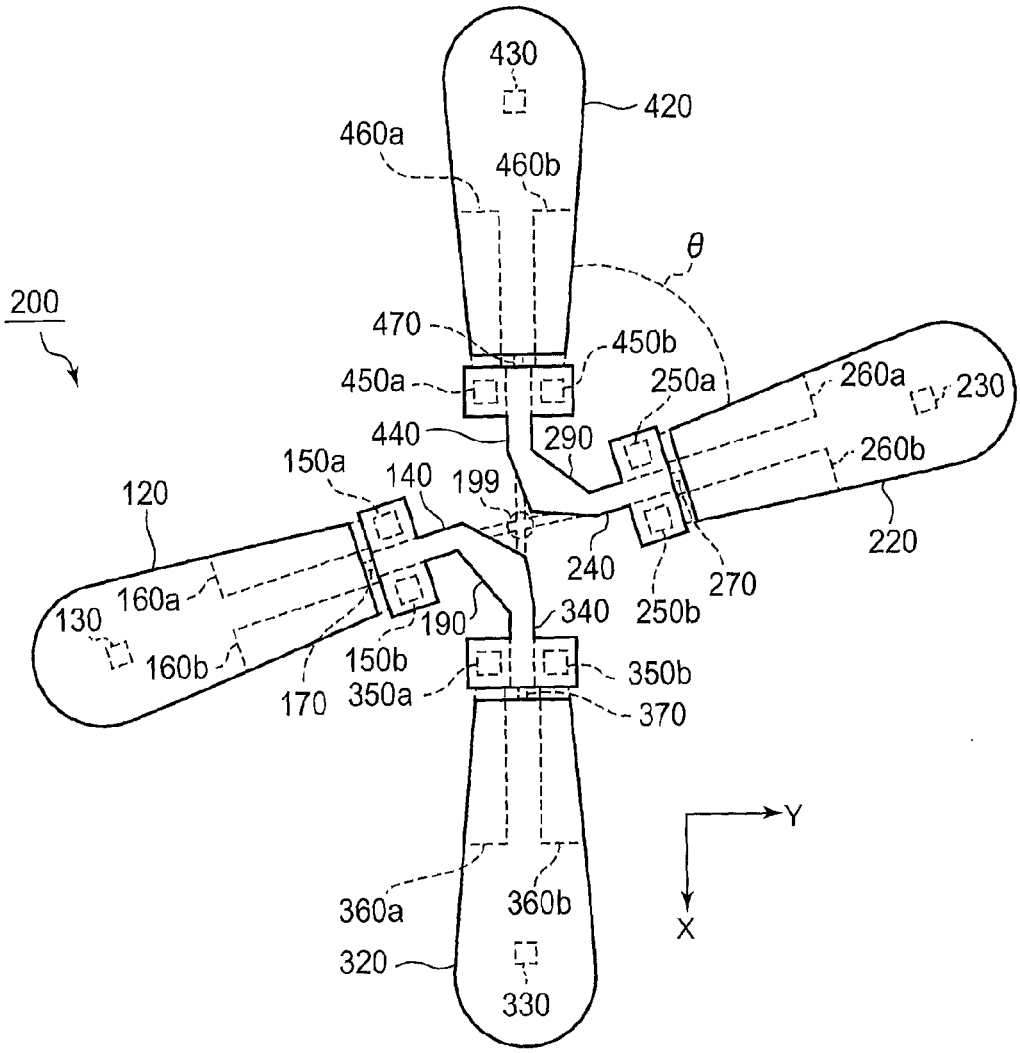
FIG. 9 is a plan view of a multi-frequency circular polarization antenna according to a second embodiment of the present invention.
Figure 10:
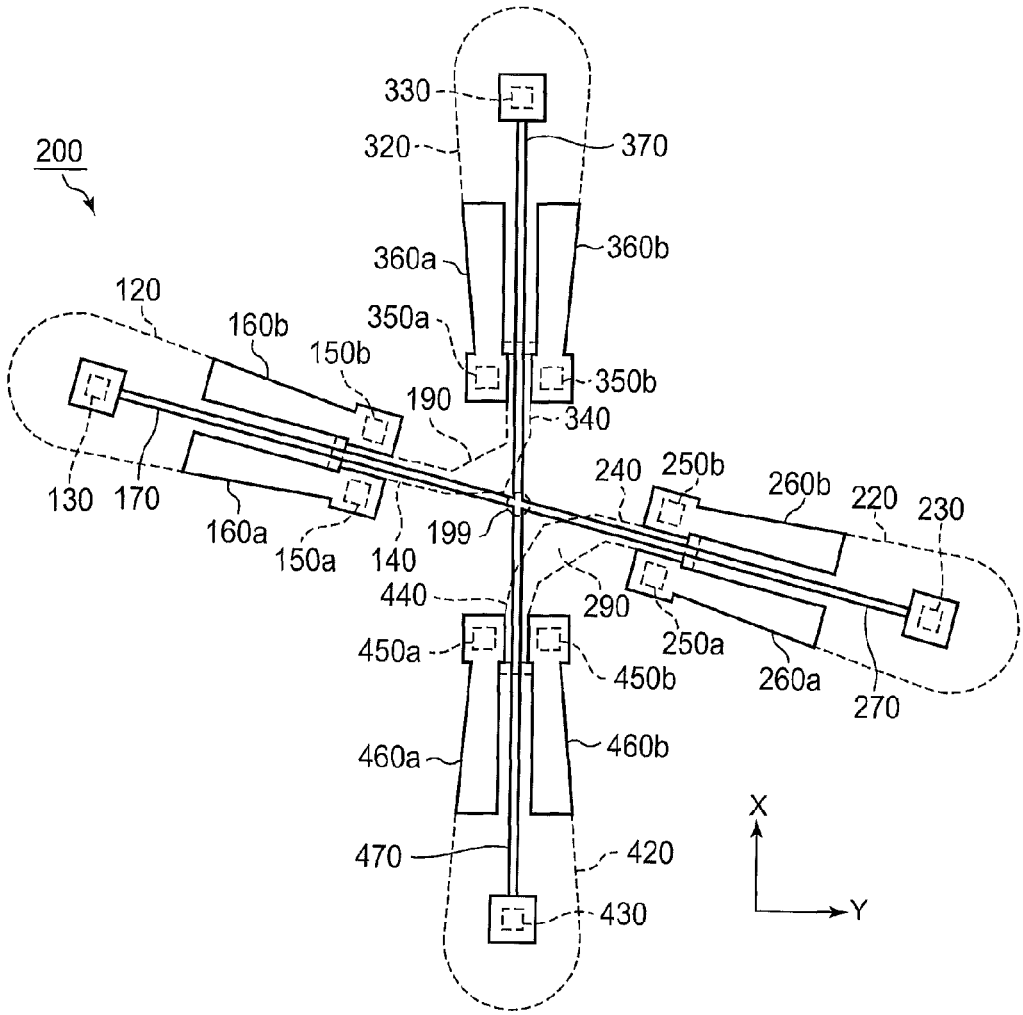
FIG. 10 is a bottom view of the multi-frequency circular polarization antenna illustrated in FIG. 9.

As illustrated in FIG. 9 and FIG. 10, in the multi-frequency circular polarization antenna 200, the input/output terminals 110 and 310 of the multi-frequency circular polarization antenna 100 according to the first embodiment are connected to form one input/output terminal 190, and, similarly, the input/output terminals 210 and 410 of the multi-frequency circular polarization antenna 100 according to the first embodiment are connected to form one input/output terminal 290. The rest of the configuration is the same as the multi-frequency circular polarization antenna 100 according to the first embodiment. Note that the electrical configuration of the multi-frequency circular polarization antenna 200 is represented by the equivalent circuits illustrated in FIG. 11.

Figure 12A:
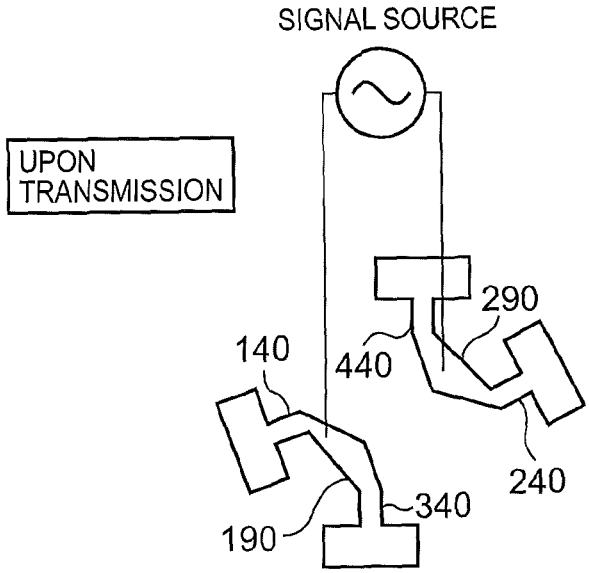
FIG. 12A is an enlarged view of an input/output terminal parts, illustrating a configuration of the multi-frequency circular polarization antenna illustrated in FIG. 9 upon transmission.

As illustrated in FIG. 12A, the input/output terminal 190 and the input/output terminal 290 are connected with a signal source through feeding wires. Upon transmission, signals are given to the input/output terminals 190 and 290 from this signal source, so that the multi-frequency circular polarization antenna 200 emits circular polarization.

Figure 12B:
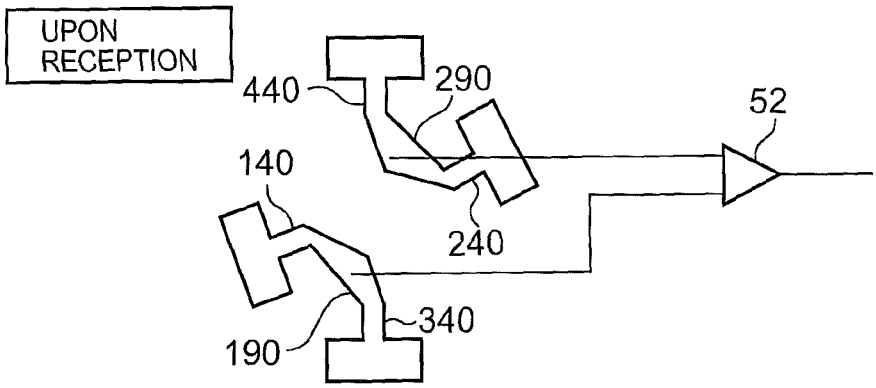
FIG. 12B is an enlarged view of input/output terminal parts, illustrating a configuration of the multi-frequency circular polarization antenna illustrated in FIG. 9 upon reception.

As illustrated in FIG. 12B, the input/output terminals 190 and 290 are connected with an amplifier 52. The multi-frequency circular polarization antenna 200 converts the received circular polarization into an electrical signal and transmits the electrical signal to the amplifier 52 from the input/output terminals 190 and 290. The amplifier 52 is formed with, for example, a low noise amplifier and/or the like.

In the multi-frequency circular polarization antenna 200, signals are given to one pair of input/output terminals, formed with the input/output terminal 190 and the input/output terminal 290, so that the antenna elements (120 and 220) and the antenna elements (320 and 420) emit radio waves having a phase difference. Consequently, the values of the lumped constant components such as the shunt inductor Lsh, the series capacitor Cser, and the series inductor Lser, provided in the antenna conductor of the multi-frequency circular polarization antenna 200, are adjusted.

Figure 11:
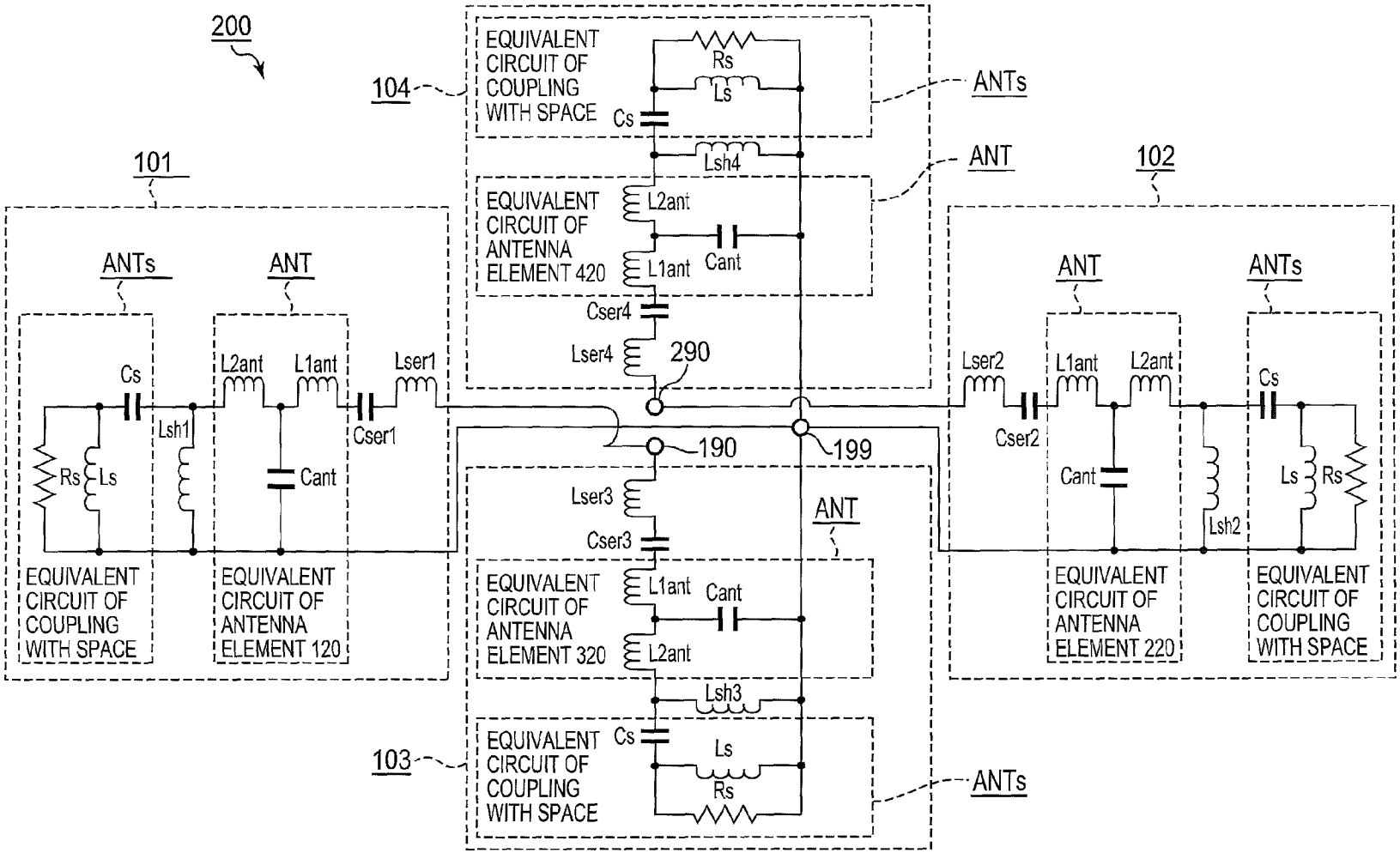
FIG. 11 is a diagram illustrating an overview of equivalent circuits of the multi-frequency circular polarization antenna illustrated in FIG. 9.
Figure 13A:
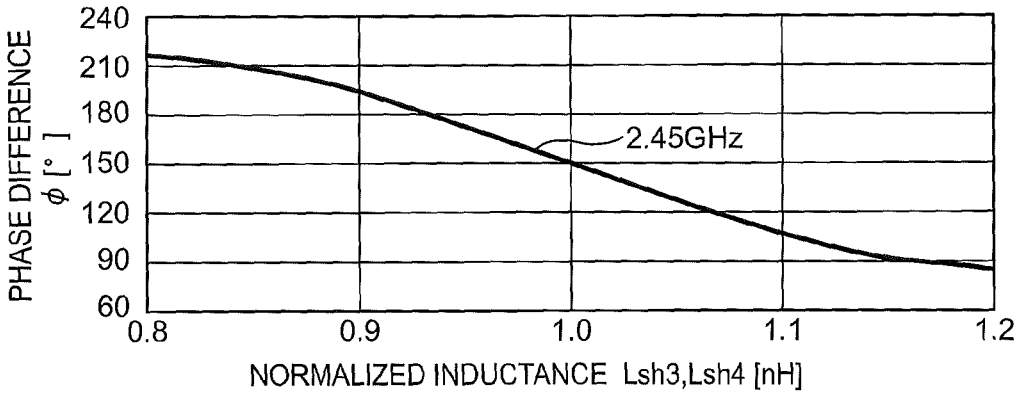
FIG. 13A, FIG. 13B and FIG. 13C are diagrams illustrating the amount of change of phase difference $\phi$ when the value of each element illustrated in FIG. 11 is changed.
Figure 13B:
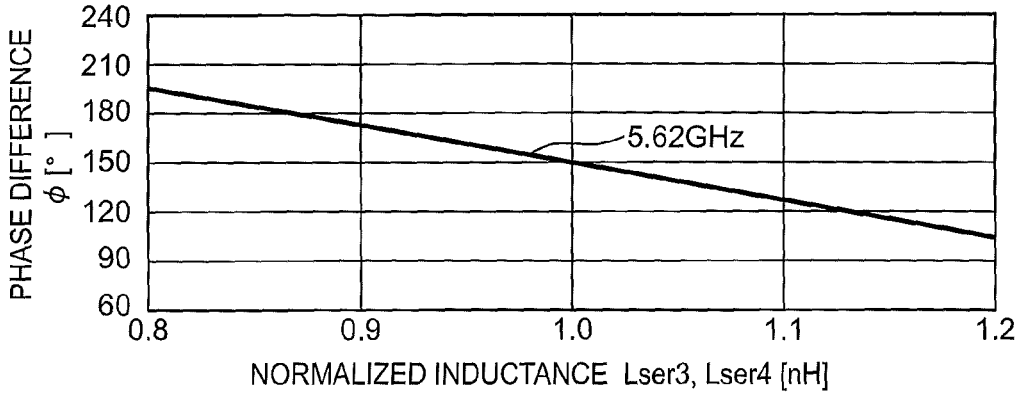
Figure 13C:
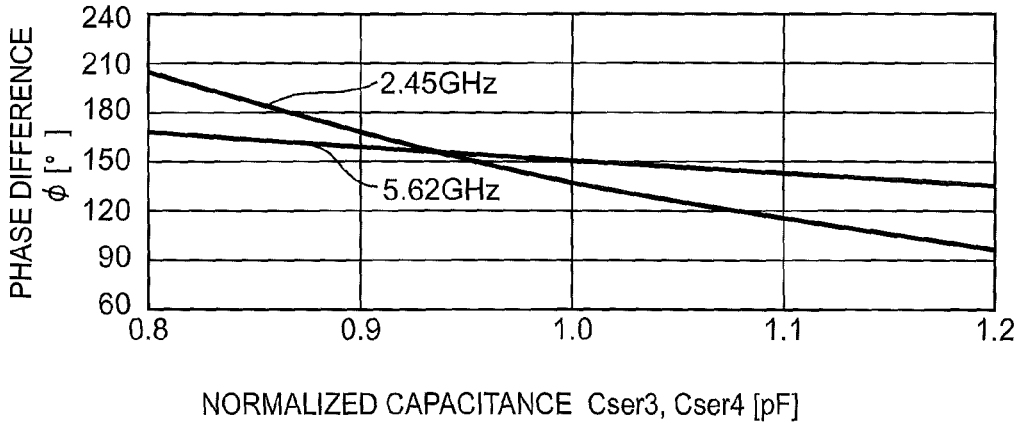

For example, when the angle formed by the antenna elements (120 and 220) and the antenna elements (320 and 420) is θ, it is possible to generate right-hand circular polarization of an axial ratio of 1, by adjusting the values of Lsh3 and Lsh4, the values of Lser3 and Lser4, and the values of Cser3 and Cser4, illustrated in FIG. 11, such that the phase difference ϕ between radio waves emitted from the antenna elements (120 and 220) and the antenna elements (320 and 420) becomes: $\phi=\pi-\theta$. Note that, by adjusting the values of Lsh3 and Lsh4, it is possible to adjust phase mainly in the 2 GHz band, and, by adjusting the values of Lser3 and Lser4, it is possible to adjust phase in the 5 GHz band. Also, by adjusting the values of Cser3 and Cser4, it is possible to adjust phase in both the 2 GHz band and the 5 GHz band. Also, when the values of Lsh3, Lsh4, Lser3, Lser4, Cser3 and Cser4 are increased, the phase difference ϕ between radio waves to be emitted also increases, and, when the values are made smaller, the phase difference ϕ also becomes smaller. FIG. 13A, FIG. 13B and FIG. 13C illustrate the amount of change of the phase difference ϕ when the value of each element is changed.

In this way, by adjusting the values of the lumped constant components of the multi-frequency circular polarization antenna 200, it is possible to realize the multi-frequency circular polarization antenna 200 having an equal size to the multi-frequency circular polarization antenna 100 of the above first embodiment, without adding a new circuit for phase control by phase lines and/or the like.

(Modification)

This invention is by no means limited to the above first embodiment, and various modifications and applications are possible. For example, although an example has been illustrated above with the first embodiment where oscillation occurs in two frequency bands near 2.5 GHz and near 5.2 GHz and the gain increases, this is by no means limiting.

For example, two arbitrary frequency bands can be combined. As described above, the element constants of the equivalent circuit ANT of the antenna elements 120, 220, 320 and 420 and the equivalent circuit ANTs of coupling with space are determined automatically by the size of the antenna elements 120, 220, 320 and 420. Consequently, considering the element constants that are determined by the size of the antenna elements 120, 220, 320 and 420, by setting the inductance of the shunt inductor Lsh, the capacitance of the series capacitor Cser, and the inductance of the series inductor Lser as appropriate, such that oscillation points are produced near a plurality of target frequencies, it is possible to achieve sufficient gain in a plurality of arbitrary frequency bands.

Oscillation does not have to occur in two frequency bands. For example, given a general cross-dipole antenna, it is possible to make the angle to be formed by the dipole antennas less than 90 degrees and make the phase difference in the supplier be the angle to be formed by the dipole antennas. According to this configuration, it is possible to reduce the area with respect to general cross-dipole antennas as well.

This invention is not limited to the above second embodiment, and various modifications and applications are possible. For example, although an example has been illustrated above with the second embodiment where the input/output terminals 110 and 310 and the input/output terminals 210 and 410 of the multi-frequency circular polarization antenna 100 of the above first embodiment are formed to be connected, this is by no means limiting. The input/output terminals 190 and 290 may as well be formed to be connected with the input/output terminals 110 and 410 and the input/output terminals 210 and 310 of the multi-frequency circular polarization antenna 100 of the above first embodiment. In this case, a signal to be given to the input/output terminals 190 and 290 of the multi-frequency circular polarization antenna 200 is emitted as left-hand polarization.

Furthermore, the present invention is by no means limited to the above first and second embodiments, and various modifications and applications are possible.

For example, the patterns arranged on one main surface of the substrate 99 and the patterns arranged on the other main surface have been connected by vias with the above first and second embodiments. However, such connection may be made by means of capacitive coupling and inductive coupling, instead of using vias.

Although inductors and conductors have been formed with lines (circuit patterns) with the above first and second embodiments, it is equally possible to form part or all of the inductors and conductors by, for example, chip parts.

Although circuits have been arranged on one surface and on the other main surface of the substrate 99 with the above first and second embodiments, it is equally possible to arrange circuits on only one main surface.

Although configuration examples to arrange circuit elements on a dielectric substrate have been shown above with the first and second embodiments, it is equally possible not to arrange a substrate if circuit elements can be held.

Although preferred embodiments of the present invention have been described above, the present invention is by no means limited to such specific embodiments, and the present invention covers as well the invention recited in the claims and its equivalent scope.

Having described and illustrated the principles of this application by reference to one or more preferred embodiments, it should be apparent that the preferred embodiments may be modified in arrangement and detail without departing from the principles disclosed herein and that it is intended that the application be construed as including all such modifications and variations insofar as they come within the spirit and scope of the subject matter disclosed herein.

What is claimed is:

1. A multi-frequency circular polarization antenna comprising first and second multi-frequency antennas, each including a configuration in which a first antenna and a second antenna are arranged in a substantially mirror-symmetrical manner, wherein:

the first antenna has a plurality of oscillation frequencies and comprises a first input/output terminal, a first antenna conductor, a series circuit of a first inductor and a first capacitor, the series circuit connecting the first input/output terminal and the first antenna conductor, and a second inductor, one end of which is connected to the first antenna conductor;

the second antenna has a plurality of oscillation frequencies and comprises a second input/output terminal, a second antenna conductor, a series circuit of a third inductor and a second capacitor, the series circuit connecting the second input/output terminal and the second antenna conductor, and a fourth inductor, one end of which is connected to the second antenna conductor and the other end of which is connected to the other end of the second inductor; and the first multi-frequency antenna and the second multi-frequency antenna are arranged to make a predetermined angle that is less than 90 degrees, such that a center point of the first multi-frequency antenna and a center point of the second multi-frequency antenna overlap, and the other end of the fourth inductor of the first multi-frequency antenna is connected to the other end of the fourth inductor of the second multi-frequency antenna.

2. The multi-frequency circular polarization antenna according to claim 1, wherein the plurality of oscillation frequencies of the first antenna and the plurality of oscillation frequencies of the second antenna are substantially the same.

3. The multi-frequency circular polarization antenna according to claim 1, further comprising a dielectric plate, wherein:

the first and second input/output terminals and the first and second antenna conductors are formed on one surface of the dielectric plate;

the second and fourth inductors are arranged on the other surface of the dielectric plate, and, through vias, the one end of the second inductor is connected to the first antenna conductor and the one end of the fourth inductor is connected to the second antenna conductor;

the first capacitor is formed with part of the first antenna conductor, a first conductor that is arranged on the other surface of the dielectric plate and faces the part of the first antenna conductor, and the dielectric plate that is located between the part of the first antenna conductor and the first conductor;

the second capacitor is formed with part of the second antenna conductor, a second conductor that is arranged on the other surface of the dielectric plate and faces the part of the second antenna conductor, and the dielectric plate that is located between the part of the second antenna conductor and the second conductor;

the first inductor is arranged on the one surface of the dielectric plate, one end of the first inductor being connected to the first conductor through a via and the other end of the first inductor being connected to the first input/output terminal; and the third inductor is arranged on the one surface of the dielectric plate, one end of the third inductor being connected to the second conductor through a via and the other end of the third inductor being connected to the second input/output terminal.

4. The multi-frequency circular polarization antenna according to claim 1, further comprising:

a first signal source, one end of which is connected to the first input/output terminal of the first multi-frequency antenna and the other end of which is connected to the second input/output terminal of the first multi-frequency antenna; and a second signal source, one end of which is connected to the first input/output terminal of the second multi-frequency antenna and the other end of which is connected to the second input/output terminal of the second multi-frequency antenna, wherein, between a signal generated by the first signal source and a signal generated by the second signal source, an amplitude is the same, and a phase difference corresponds to the predetermined angle.

5. The multi-frequency circular polarization antenna according to claim 4, wherein, between the signal generated by the first signal source and the signal generated by the second signal source, the amplitude is the same, and the phase difference is π−the predetermined angle.

6. The multi-frequency circular polarization antenna according to claim 1, wherein:

the first input/output terminal of the first multi-frequency antenna and the first input/output terminal of the second multi-frequency antenna are connected to form one input/output terminal, and the second input/output terminal of the first multi-frequency antenna and the second input/output terminal of the second multi-frequency antenna are connected to form one input/output terminal;

the multi-frequency circular polarization antenna further comprises a signal source, one end of which is connected to the first input/output terminal of the first multi-frequency antenna and the other end of which is connected to the second input/output terminal of the first multi-frequency antenna; and an inductance of the first through fourth inductors and a capacitance of the first and second capacitors are adjusted such that, between a radio wave emitted from the first multi-frequency antenna and a radio wave emitted from the second multi-frequency antenna, an amplitude is the same, and a phase difference corresponds to the predetermined angle.

7. The multi-frequency circular polarization antenna according to claim 6, wherein the inductance of the first through fourth inductors and the capacitance of the first and second capacitors are adjusted such that, between the radio wave emitted from the first multi-frequency antenna and the radio wave emitted from the second multi-frequency antenna, the amplitude is the same, and the phase difference is π−the predetermined angle.

* * * * *